United States Patent [19]

Lee, Jr.

[11] 4,173,882

[45] Nov. 13, 1979

[54] MOUNTING FOR IRONING DIES

[75] Inventor: Harry W. Lee, Jr., Chesterfield County, Va.

[73] Assignee: Reynolds Metals Company, Richmond, Va.

[21] Appl. No.: 927,347

[22] Filed: Jul. 24, 1978

[51] Int. Cl.[2] ..... B21D 22/28

[52] U.S. Cl. ..... 72/349; 72/468

[58] Field of Search ..... 72/347, 348, 349, 344, 72/467, 468

[56] References Cited

U.S. PATENT DOCUMENTS

| | | | |
|---|---|---|---|
| 1,742,795 | 1/1930 | Tanner | 72/349 X |
| 3,399,558 | 9/1968 | Smith et al. | 72/468 |
| 3,735,629 | 5/1973 | Paramonoff | 72/349 |
| 3,930,396 | 1/1976 | Martinez | 72/347 |
| 3,943,740 | 3/1976 | Bartenstern | 72/349 |
| 4,109,502 | 8/1978 | Schafler | 72/349 |

*Primary Examiner*—Leon Gilden

*Attorney, Agent, or Firm*—Glenn, Lyne, Girard, Clark & McDonald

[57] ABSTRACT

An improved mounting for ironing dies used in forming drawn and ironed metal articles, such as can bodies, at high speeds is disclosed. The support is formed of a metal ring having a plurality of fingers extending outwardly and axially from the ring. These fingers act as springs to allow the ironing dies, which are deflectably mounted on these fingers, to shift slightly in a direction generally perpendicular to their axes to accommodate off-centered cups which pass through the ironing dies to be formed into can bodies. The improved support is unaffected by the lubricant present in great amounts in the die cavities and on the cups so that the ironing die support will not deteriorate over time.

7 Claims, 2 Drawing Figures

MOUNTING FOR IRONING DIES

BACKGROUND OF THE INVENTION

Drawn and ironed metal articles, such as can bodies are conventionally formed while carried on a punch through a set of dies including at least one ironing die which thins and lengthens the sidewall of the can body. This operation is repeated through the same set of dies at the rate of more than 100 can bodies per minute. While it is desired that the cups from which the can bodies are formed are uniform and are passed through the dies by a punch carrying the cups along their axes uniformly, the cups are not always uniform and do not always fit onto the punch exactly the same. Thus, the ironing dies must be deflectably mounted so that they may adjust for variations in the cups so that off-centered cups may successfully pass through the dies without damaging the dies.

In the past, ironing dies have been deflectably mounted upon rubber O-rings. These rings are resilient and enabled the ironing dies to deflect in a direction generally perpendicular to their axes of rotation in an amount between about 0.015 and 0.020 inch (0.038 and 0.051 centimeter) from their normally centered position.

Several problems result when using rubber O-rings for this purpose. First, the rings are extruded or molded of rubber. This does not permit the rings to be formed with the fine tolerances necessary to always produce rings which are perfectly centered and sized. Thus, rings which do not meet original specifications must be discarded.

A second problem encountered when employing rubber O-rings as the deflectable mounting for ironing dies results from the lubrication necessary in the die set to form can bodies. Throughout the drawing and ironing operation, the drawing and ironing tools and the cup body are continuously bathed in a lubricant. The lubricant may eventually swell the rubber O-ring out of shape so that the central opening in the O-ring is no longer centered and the ironing dies are not properly aligned with the punch. Thus, frequent replacement of the O-rings is required.

Even if a properly sized O-ring has been provided, and the O-ring has not been affected substantially by the lubricant, the rings do not continually exactly realign the ironing dies after the dies have deflected. Again, due to the nature of the rubber forming the rings, with time the ability of the O-rings to return the dies to their proper alignment position after a deflection is reduced, i.e., the O-rings lose their elasticity. Thus, in addition to the need for replacing O-rings due to their swelling from the lubricant, O-rings must be replaced due to their elastic fatigue with time.

It is thus a primary purpose of the instant invention to provide an improved deflectable mounting for ironing dies in a can drawing and ironing apparatus which may be precisely machined to original specifications such that initial alignment of the ironing dies will result. It is also a primary object of the instant invention to provide an ironing die mounting which will not become substantially elastically fatigued over time either due to the deflection stresses placed on the mounting by the ironing dies or from the lubricant which is used to bathe the drawing and ironing apparatus.

THE PRESENT INVENTION

By means of the present invention an ironing die set is produced which includes a deflectable die mounting which is free from the defects inherent in the O-ring supports employed by the prior art. The deflectable ironing ring mounting of the present invention is formed of a metal ring having a plurality of fingers protruding from its ring and formed as an integral part of the ring. The ironing dies are deflectably mounted upon these fingers. The fingers act as springs and allow the ironing dies to deflect from their normally centered alignment in order to compensate for an off-centered cup. Due to their spring-like nature, the fingers immediately realign the dies to their normally centered position upon the removal of the punch from the die set. The fingers and the ring carrying them are formed of a metal having high initial and continuing elasticity, i.e., high spring strength, such that the fingers are not permanently deformed but return to their original positions upon removal of the stress from them over long time spans. Again due to their metallic construction, the fingers will not be adversely affected by the lubricant bath environments in which they must operate. Thus, increased life for the ironing ring mounting results.

BRIEF DESCRIPTION OF THE DRAWINGS

The ironing die set of the instant invention will now be more fully described with reference to the drawings in which.

DETAILED DESCRIPTION OF THE DRAWINGS

Turning now to the Figures, a drawing and ironing die set is illustrated for the formation of metal cans formed of metals such as aluminum, steel and the like. Identical parts in the Figures are given identical drawing numerals and similar parts are given numerals in FIG. 1 and the same numerals followed by the letter a in FIG. 2.

As shown in the Figures, a punch 52 carrying a can body 54 has partially completed its stroke through the set of drawing and ironing dies 1 or 1*a*. As the stroke direction forming the can body 54 operates from right to left as shown in the Figures, the Figures will be described in this manner.

Figure 1:
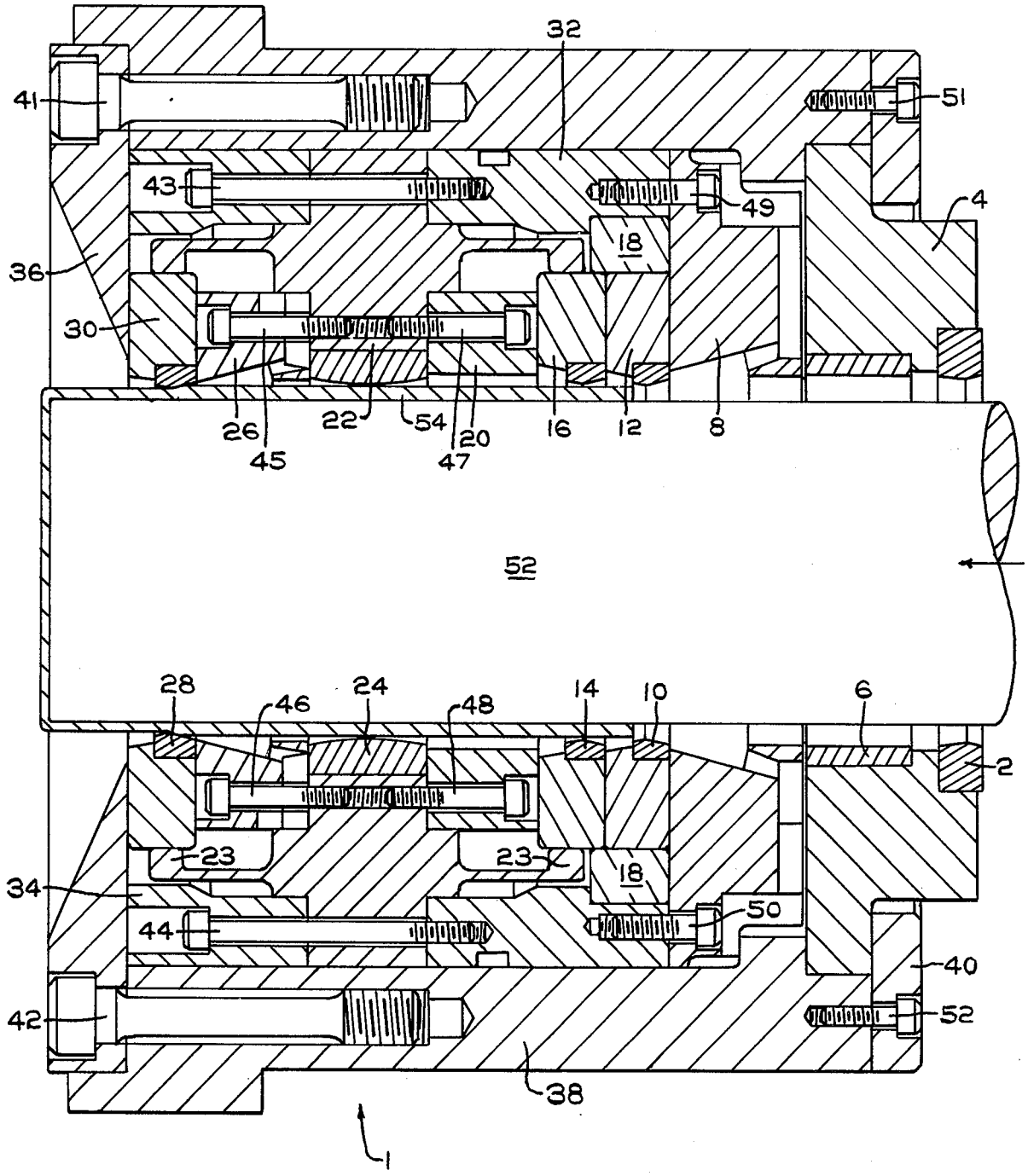
FIG. 1 is a cross-sectional view of a drawing and ironing can forming die set illustrating the deflectable mounting means for the ironing dies in accordance with the instant invention.

Upon entering the die set 1 or 1*a*, can body 54 contacts a redraw die which is formed of carbide nib 2 and a case 4. Optionally, as shown in FIG. 1, the case 4 may include a bushing 6, which is formed of a material such as bronze or brass, to aid in aligning the punch and avoiding jams. However, this element is not always required and is not shown in FIG. 2.

The can body 54, carried along punch 52, then passes lubrication distribution ring 8. The can body 54 does not contact this ring 8. This ring is connected to the supply of lubricant (not shown) for the die set 1 or 1*a* and helps distribute the lubricant throughout the system. The can body 54 is then ironed between punch 52 and an ironing die comprising carbide nib 10 and casing 12 or 12*a*. After leaving this point, the can body 54 contacts a pilot die comprising nib 14 and case 16 or 16*a*. The ironing die nib 10 and pilot die nib 14 are linked together as by the overlap of casings 12*a* and 16*a* in FIG. 2 or by means of a linking retainer ring 18, as shown in FIG. 1, so that whenever one of the dies is deflected the other is deflected accordingly to maintain these dies in alignment with one another. Ironing takes place between die nib 10 and the punch 52, as is known in the art. No additional ironing takes place at the nib 14. This nib 14 is provided to produce even ironing for a can 54 with an uneven open end by the nib 10.

In the die set 1 a spacer 20 is provided after the pilot die and prior to bushing 24. Due to the shape of the casing 16*a* in die set 1*a*, no equivalent spacer is provided. Bushing 24 is similar to bushing 6 in that it aids in alignment of the can body 54 and reduces the chances of jamming in the system as the can body 54 contacts this bushing 24. The can body 54 then passes over, but does not contact, lubrication distribution ring 26, which acts in the same manner as lubrication distribution ring 8. The can body 54 then contacts another ironing die 20 comprising nib 28 and case 30 or 30*a*, which acts in combination with punch 52 to reduce the thickness and increase the length of the can body 54 to its final dimensions. Due to the shape of die casing 30*a*, O-ring 27 is employed as a spacer between casing 30*a* and lubrication distibution ring 26.

The various dies and spacers are maintained together as a unit by means of tool cartridge case 38, end ironing die retainer 36, and redraw die retainer 40, in combination with bolts 41 through 51.

As previously mentioned, ironing die nibs 10, 14 and 28 are mounted to enable them to deflect slightly from their centered axes to accommodate can bodies 54 which are not perfectly centered. In doing this, ironing die nib 10 and ironing die nib 14 are linked together in their movement, while ironing die nib 28 is freely movable of itself. The amount of alignment motion permitted for the die nibs 10, 14 and 28 is in the order of 0.015 to 0.020 inch (0.038 to 0.051 centimeters) in any direction from their axes. It is the way in which this movement is permitted in the die set 1 which forms the basis of the instant invention.

Figure 2:
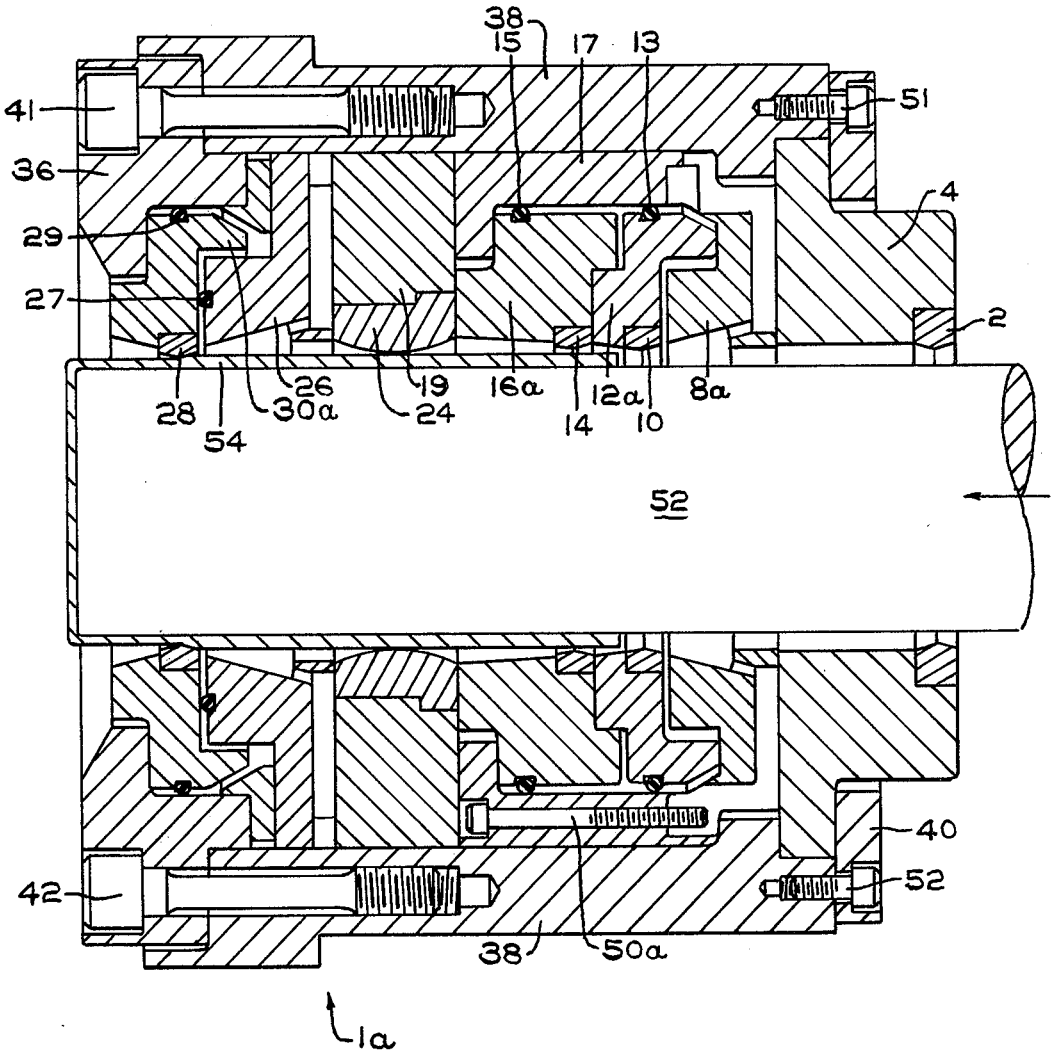
FIG. 2 is a cross-section view of an ironing die set employing the mounting mechanism employed in the prior art.

Looking at FIG. 2, the die cases 12*a*, 16*a*, and 30*a* are surrounded respectively by O-rings 13, 15, and 29. These are rubber rings which completely surround the die cases and space the cases 12*a* and 16*a* from retainer 17 and case 30*a* from retainer 36. Due to the resilient nature of the rubber forming these O-rings, the O-rings will "give" to the cases when an off-centered can body 54 causes the die nibs 10, 14, or 28 to attempt to realign themselves. Due to the ability of the O-rings to elastically rebound, when the punch 52 is retracted the die nibs 10, 14 and 28 return to their normally centered alignment.

While, in theory, such an operation seems reliable, in actual practice such is not the case. First, rubber, of which these O-rings are formed, is subject to elastic fatigue with time and, thus, with time the O-rings lose their elastic rebound properties. Therefore, with age, the O-rings do not return the die nibs 10, 14, and 28 to their normally centered alignment positions and must be replaced.

While this problem is substantial, an even greater problem results from the use of rubber O-rings as the deflectable supports for ironing dies. As previously mentioned, the entire die set is bathed with lubrication throughout its operation. Thus, as previously mentioned, lubrication distribution (not shown) for the die set and distribute this lubrication throughout the die set.

The lubricant which is employed attacks the rubber O-rings. This causes the O-rings to swell. Of course, this swelling will not be even throughout the O-ring. Thus, the O-rings themselves, in time, will cause a misalignment of the ironing dies with respect to the punch 52 and the can body 54. When this occurs, the die set must be removed and disassembled for replacement of the O-rings, leading to extra manpower requirements and down-time to repair the die set.

In the present invention, the rubber O-rings which in the past have deflectably supported the ironing dies have been replaced by a series of metal fingers 23 protruding from at least one metal ring 22. The fingers 23 and ring 22 are formed of a metal having high spring strength. Such a material will not lose its elastic rebound ability with time and thus will not need replacement for this cause. Further, and more importantly, such a material is not attacked by the lubricant in the die set and will not swell up and cause misalignment of the dies for this reason. A typical metal which may be employed is type A-2 tool steel having a Rockwell hardness in the range of from about 55 to 60, C scale.

The ring 22 and fingers 23 thereon may be formed by casting as a unit. However, it is preferred to machine the fingers 23 from a ring of the width of the entire mounting to be formed. The machining may be accomplished by any of a plurality of techniques known to those skilled in the art. A preferred method of machining the fingers 23 is by milling.

As is seen in FIG. 1, ironing die cases 30 and 16 rest upon the fingers 23 of the support 22. Ironing die nib 28 is free to move within the limits previously specified. Ironing die cases 12 and 16 are linked together by means of linking retainer 18 so that the motion of one of the dies will be transferred to the other die to maintain these two dies in alignment. Optionally, instead of employing retaining ring 18, the cases 16 and 12 may be linked together in the manner shown in FIG. 2 for die cases 12*a* and 16*a*, i.e., the case 16*a* may overlap around case 12*a* to link these two die cases together.

Optionally, a pair of rings 22 may be employed with a single set of fingers 23 protruding from each ring 22. In this case, the rings would be mounted back to back to provide a composite mounting equivalent to the single ring 22 illustrated. Of course, if ironing die nib 28 is not required, a ring 22 having one set of fingers protruding therefrom would be sufficient.

From the foregoing, it is clear that the present invention provides a stable and improved apparatus for deflectably mounting dies in a die set.

While present preferred embodiments of the invention have been illustrated and described, it will be understood that the invention may be otherwise variously embodied and practiced within the scope of the following claims.

I claim:

1. In a die set for forming drawn and ironed metal articles comprising a plurality of die nibs, a plurality of die casings holding said die nibs, means for lubricating said die set and means for deflectably mounting said die nibs and die casings the improvement wherein said means for deflectably mounting said die nibs and die casings comprises a metal ring having a plurality of metal fingers extending from said ring along its axis, said fingers having sufficient spring strength to permit said die nibs and die casings to deflect from and return to their original axially centered position.

2. The apparatus of claim 1 wherein said ring and fingers are formed of Type A-2 tool hardened steel.

3. The apparatus of claim 2 wherein said steel has a Rockwell hardness of between 55 and 60, C scale.

4. The apparatus of claim 1 wherein said fingers allow said die nibs and die casings to deflect between about 0.015 and 0.020 inch (0.038 and 0.051 centimeters).

5. The apparatus of claim 1 wherein said fingers and said ring are formed from a common ring.

6. The apparatus of claim 5 wherein said fingers and said ring are milled from said common ring.

7. The apparatus of claim 1 wherein said mounting includes a pair of rings, each of said rings having a plurality of fingers extending from said ring.

* * * * *